United States Patent [19]

Düll et al.

[11] 4,389,942

[45] Jun. 28, 1983

[54] SWITCH FOR A CARRIAGE OF A TWO TRACK SUSPENSION RAILROAD

[75] Inventors: Hans-Jürgen Düll, Langensendelbach; Adolf Hillmer, Erlangen, both of Fed. Rep. of Germany

[73] Assignee: Siemens Aktiengesellschaft, Munich, Fed. Rep. of Germany

[21] Appl. No.: 213,639

[22] Filed: Dec. 5, 1980

[30] Foreign Application Priority Data

Dec. 12, 1979 [DE] Fed. Rep. of Germany ..... 2949978

[51] Int. Cl.[3] ..... B61B 3/00

[52] U.S. Cl. ..... 104/103; 104/130

[58] Field of Search ..... 104/96, 101, 103, 104, 104/130, 94; 246/385-387, 389-391

[56] References Cited

U.S. PATENT DOCUMENTS

| | | | |
|---|---|---|---|
| 462,022 | 10/1891 | Spaulding | 104/103 X |
| 3,855,938 | 12/1974 | Peveraro | 104/130 |
| 3,878,792 | 4/1975 | Larson | 104/130 X |
| 4,089,270 | 5/1978 | Blake | 104/130 |

FOREIGN PATENT DOCUMENTS

| | | | |
|---|---|---|---|
| 1459634 | 2/1970 | Fed. Rep. of Germany . | |
| 2723733 | 11/1978 | Fed. Rep. of Germany | 104/130 |
| 1248112 | 10/1960 | France | 104/103 |
| 609351 | 9/1960 | Italy | 104/94 |

*Primary Examiner*—Randolph Reese

*Attorney, Agent, or Firm*—Kenyon & Kenyon

[57] ABSTRACT

A switch for lateral guide rollers of a two track suspension railroad has a one piece central switch point which is arranged at the fork point of the inner guide surfaces and with which, in the vicinity of its free end, two further switch points may be associated which form parallel sections of guide surfaces which can be swung to the fixed guide surfaces or the central switch point.

4 Claims, 14 Drawing Figures

SWITCH FOR A CARRIAGE OF A TWO TRACK SUSPENSION RAILROAD

This invention relates to two track suspension railroads and in general and more particularly to a switch for the guide rails of a two track suspension railroad.

In German Pat. No. 14 59 634, a switch for two track suspension railroad vehicles is described which has tracks for the support wheels, which have inflated tires, and guide surfaces which are approximately perpendicular and parallel to the tracks for approximately horizontally arranged guide wheels which preferably also have inflated tires. At the fork point of the inner guide surfaces, a switch point is linked onto the guide surfaces. The switch point is pivoted about a vertical axis and consists of two parts (a point part and a connecting part) which are arranged one behind the other. The two parts are linked together and pivoted about two vertical axes. The connecting part linked to the fork point includes a vertical guide rail (side wall) for the guide wheels and flanges which form the horizontal rails for the support wheels, while the point part is formed only by a vertical guide rail. The flanges of the switch point can be swung into a recess in the stationary track parts of the straight or curved tracks at its two end positions. Parts of the track are formed by further points pivoted about a vertical axis. In this design, the point must be lifted for switching, so that an elaborate positioning device is required. It is further necessary to make the point part of the two part switch point very slender, especially in switches which are traversed at high speed, to keep unevennesses at the transition point small. Thereby, and because of the two part design, the strength of the point is impaired.

SUMMARY OF THE INVENTION

It is an object of the present invention to describe a switch, with which high mechanical strength and, with simple means, a smooth transition from the switchable to the fixed guide parts can be achieved.

In a switch of the type mentioned above, this problem is solved by making the central switch point of one piece and forming parallel guide surfaces in the region of its free end by means of two further switch points arranged in the recesses of the fixed guide surfaces, which can be swung to the fixed guide surfaces or to the cental switch part.

In the switch according to the present invention, the central switch point has only one joint, so that better availability, greater simplicity and higher mechanical strength then in the known design are achieved. The switchable guide parts can be made very wide and can be set so that their guide surfaces lie in one plane with the guide surfaces of the fixed guide rails at the transition points. Thereby, shock-free guidance of the carriage in the switch can be achieved.

DETAILED DESCRIPTION

Figure 1:
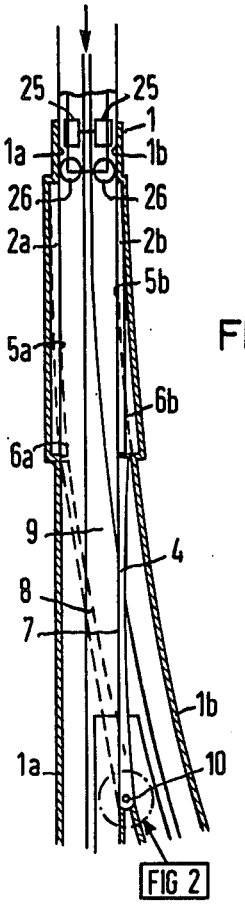
FIG. 1 is a longitudinal cross section of a box shaped track support with a switch in the straight travel position.

The track support 1 shown in FIG. 1 in a longitudinal section is of box-like design and has on its underside a slot 9 through which suspensions connecting a carriage and a cabin in the suspension railroad may pass. On both sides of the slot 9, tracks for support wheels 25 of the carriage are provided. The carriage is guided laterally by guide rollers 26 which roll on the fixed guide surfaces, i.e., fixed side walls 1*a* and 1*b* of the side walls of the box-shaped track support 1. In the switch, a one-piece central switch point 4, which is pivoted about a vertical axis 10, is linked onto the guide surfaces at the fork point of the inner guide surfaces. Associated with this central switch point 4 are further switch points 2*a* and 2*b* which are arranged in recesses in the region of the fixed side wall 1*b*. The recesses extend over the entire width of the guide surfaces. The further switch points 2*a* and 2*b* are clamped at the root of the switch and are made flexible. Their ends are adjacent to the free end of the central switch point 4.

Figure 4:
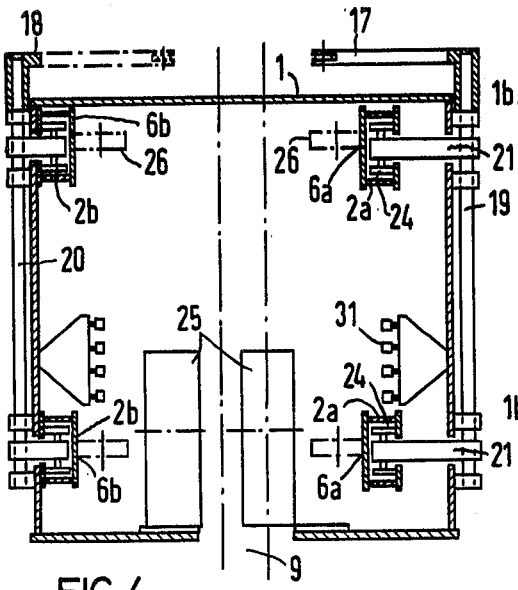
FIG. 4 is a cross section through a track support at the section line IV—IV of FIG. 3.

For straight travel, the central switch point 4 and the additional switch points 2*a* and 2*b* are brought into the position shown. The switch point 4 rests against the curved side wall and forms, with the additional switch point 2*b* projecting from the recess, a straight guide rail section with guide surfaces 5*b* and 7 lying in one plane. The switch point 2*a* remains in the recess, a smooth transition being provided between the guide surface 5*a* and the guide surface 1*a* of the side wall. Thereby, two sided, shock free guidance of the carriage is achieved with three switch points. In one part of the switch only the support wheels 25 arranged on one side of the carriage are supported on the lower girder flange because of enlargement of gap 9 (FIG. 4).

For travel into the branch, the central switch point 4 is brought into the other end position (shown dashed), in which it rests with its end against a stop of the straight side wall. The further switch point 2*a* is bent at its one end out of the recess and, with the central switch point 4, forms a curved guide track consisting of the guide surfaces 6*a* and 8. The further switch point 2*b* is moved into the recess, so that, with the guide surface 1*b* of the curved side wall, it forms an uninterrupted guide track which consists of the guide surfaces 6*b* and 1*b*.

Figure 2:
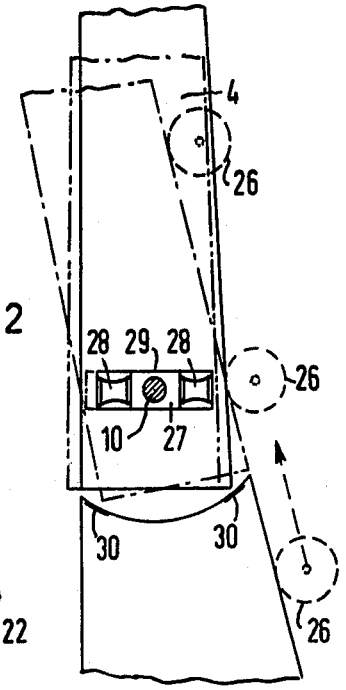
FIG. 2 is an enlarged view of a portion of the support of the central switch point.

It is advantageous to make the central switch point 4 elastically displaceable transversely to the travel axis at its support point. As is shown in the enlarged section of FIG. 2, the central switch point 4 has a cutout 29, in which a bearing member 27 for the fixed shaft 10 is arranged. The bearing member 27 is braced by compression springs 28 in such a manner that it occupies a central position in the cutout 29. The pretension of the two springs 28 is chosen so that the central position is maintained for normal travel. If the switch is negotiated properly, a stop 30 is always operative which prevents a transverse displacement of the central switch point under the action of extreme forces. If, on the other hand, a vehicle, for instance, in manually controlled switching operations, runs head on into the switch set for straight travel (see dashed arrow), a strong lateral force is exerted on the support point of the central switch point 4 because the gauge is narrowed, and the point gives way, since in this position, the stop 30 is ineffective, at first into the dashed position. Thereupon, a moment is exerted about the axis 10 which can switch the central switch point 4. In the process, an intended breaking point in the latching of the point tip is pierced and the switch is brought into the right position for the incorrectly traveling vehicle. After the latch in the point tip is broken, the transverse displacement of the switch point at its support point is cancelled by the force of the spring 28. The switch can therefor be "cut open".

Figure 3:
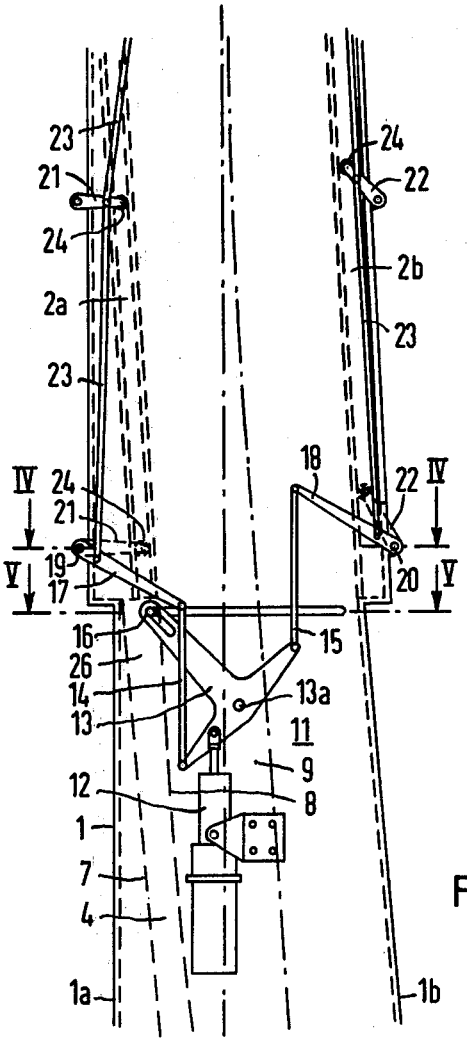
FIG. 3 illustrates an actuator for the switch points in a top view.

The drive 11 shown in FIG. 3 is used for setting the central switch point 4 and the further switch points 2*a* and 2*b*. A positioning cylinder 12 mounted at the track support 1 drives a link 13 which can rotate about an axis 13*a*. Via linkages 14 and 15, levers 17 and 18 and shafts 19 and 20 drive roller linkages 21 and 22 which are connected to linkage rods 23 and act via rollers 24 on the further switch points 2*a* and 2*b* deform them elastically according to the required guide surface contour.

The central switch point 4 is likewise actuated via the link 13 and a pin 16 which is arranged at the end of the central switch point.

Figure 5:
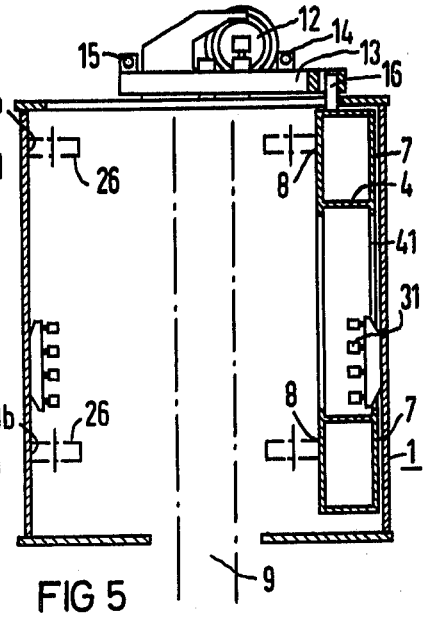
FIG. 5 is a cross section along the section V—V of FIG. 3.

For the lateral guidance of the carriage it is advantageous to provide guide rollers and guide tracks at the side walls of the box girder at the top and bottom and to connect the upper and lower guide members to each other and in the switch and to actuate them together (FIG. 4). Current rails, signal lines and control lines are to be arranged, as before, exclusively at the fixed side walls of the track support. To accomplish this, the end is designed as a fork in the construction of the upper and lower central point 4 and the connections designed as a common hollow girder 41 (FIG. 5) so that a space remains between the upper and the lower guide surfaces 7 and 8 for the current rails 31 which are arranged at the side walls of the box girder.

The central switch point 4 is equipped with latching devices in a mamner known per se.

FIG. 4 shows a cross section in the area of the further switch points 2*a* and 2*b*. Two such switch points are always arranged one above the other. The common drive 11 is disposed at the upper flange of the box girder 1, as is evident from FIG. 5.

Figure 6:
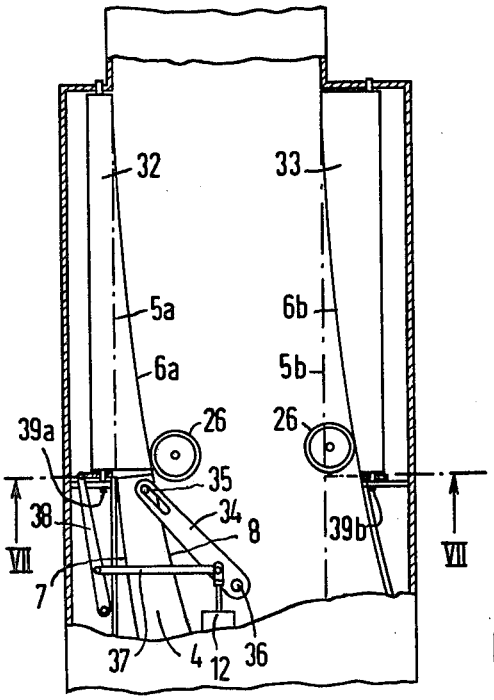
FIG. 6 illustrates a second embodiment of a switch with a different support of the additional switch points.
Figure 7:
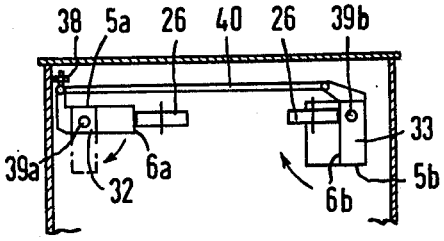
FIG. 7 is a cross section of FIG. 6.

In the embodiment shown in FIGS. 6 and 7, the two further switch points 32 and 33 can be swung about their longitudinal axes, so that, depending on the position of the central switch point 4, either curved guide surfaces 6*a* and 6*b* or, in a position shifted 90°, straight guide surfaces 5*a* and 5*b* (shown dashed) will come into engagement with the guide rollers 26 of the vehicle. For shifting the additional switch points 32 and 33 about their longitudinal axes, a steering rod 34 is linked via a pin 35 to the end of the central switch point 4. Rod 34 has its other end supported in the fixed bearing 36 and acts on a pivot bearing 39*a* via two further levers 37 and 38. This pivot bearing 39*a* is connected via a further linkage 40 to the second switch point 33 which is supported in the pivot bearing 39*b*.

Figure 8:
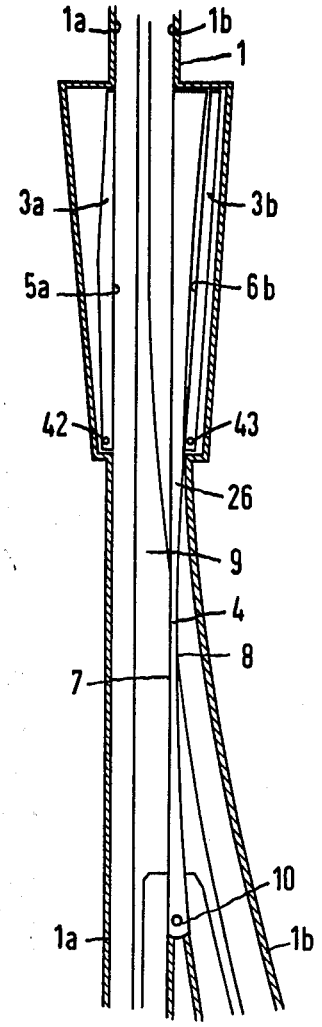
FIG. 8 illustrates a third embodiment of a switch in a longitudinal section.

According to another embodiment of the present invention, the free end of the central switch point 4 is swung into a recess in the fixed guide surfaces 1*a* and 1*b* of the straight and the curved side wall, respectively at its two end positions (FIG. 8). The two further switch points 3*a* and 3*b* are then arranged in the enlarged recesses for the central switch point 4 next to the latter and supported for rotation about vertical axes 42 and 43.

Figure 10:
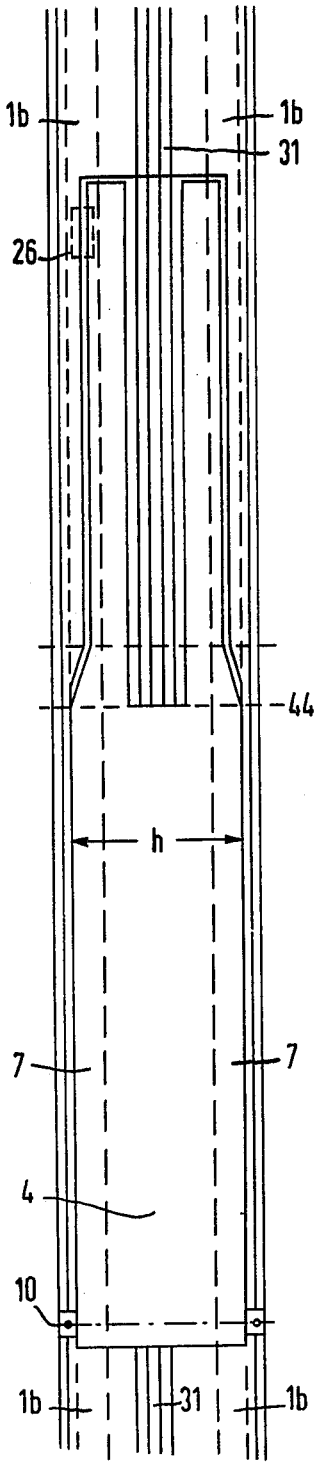
FIG. 10 is a longitudinal section of FIG. 9.
Figure 9:
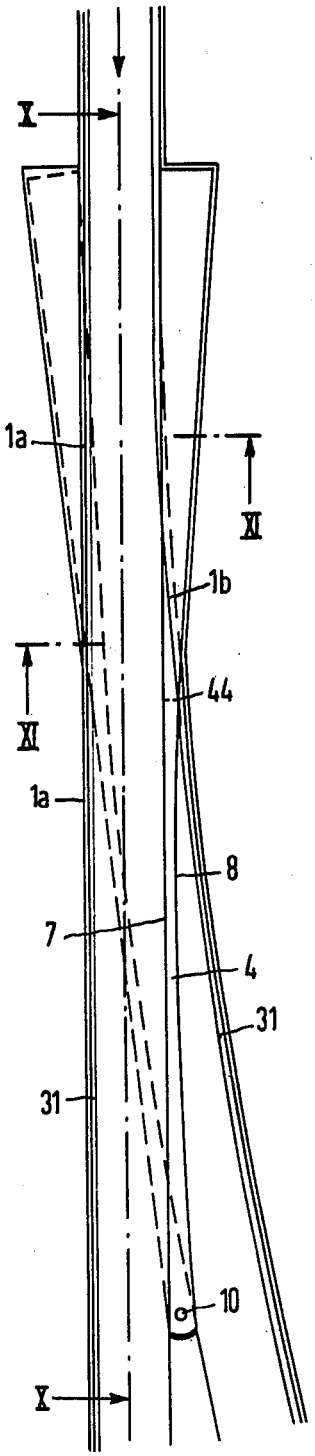
FIG. 9 illustrates a fourth embodiment of a switch in a longitudinal section.
Figure 11:
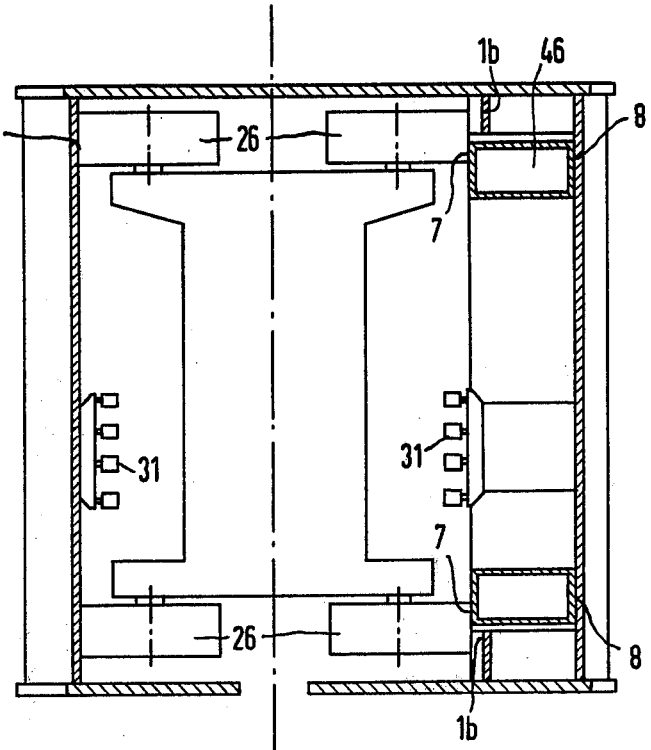
FIG. 11 is a cross section of FIG. 9.

In the embodiment shown in FIG. 9, the central switch point 4 is designed as a single part. The area of its end can be swung into recesses for the fixed guide surfaces 1*a* and 1*b*. The height h of the switch point 4 corresponds nearly to the inside height of the track support. The end of the switch point 4 that can be swung into the recess is designed in the form of a fork so that upper and lower guide surfaces 7 and 8 are formed, as shown in FIGS. 10 and 11. At the upper and lower frame parts of the carrier in the vicinity of the upper and lower flanges, guide rollers 26 are arranged. The guide rollers 26 are offset relative to the recesses and specifically so that they extend beyond the recesses in the fixed guide surfaces 1*a* and 1*b* and come into engagement with the guide surfaces 7 and 8, respectively, of the fork shaped end region of the central switch point 4. From point 44 to the axis 10, the switch point 4 is designed as a solid walled beam.

A vehicle traveling in the direction of the arrow is guided, for straight travel, from the beginning of the switch to the left of section line 44 on the left side by one-half of the fixed guide surface 1*a* and on the right side by the guide surfaces 7 of the fork shaped ends of the central switch point 4. For travel into the branch, the vehicle is guided on the left side by the guide surfaces 8 of the fork shaped ends of the central switch point 4, and on the right side, by one-half of the fixed guide surfaces 1*b*. From the section line 44 on, the entire guide surfaces 1*a* are again available on the left side for straight travel, while on the right side the guide surfaces 7 are available to the central switch point 4 over the entire width of the guide rollers. The same applies to travel into the branch. The fork shape of the switch point starts at the line designated with 44, so that the current rails 31 can be connected solidly to the side walls.

It is an important advantage of the embodiment shown in FIGS. 9 to 10 that no additional switch points are required because the guide rollers 26 are supported in the recesses for the additional switch point approximately over one-half of their width by the fixed guide surfaces 1*a* and 1*b*.

It is advantageous to equip the switch with switch setting drives the customary in standard railroads. It is then customary to monitor each individual moving part with so-called test rods as to end position and to hold it in its end position. Also for this reason, it is important to have as few moving parts as possible.

Figure 12:
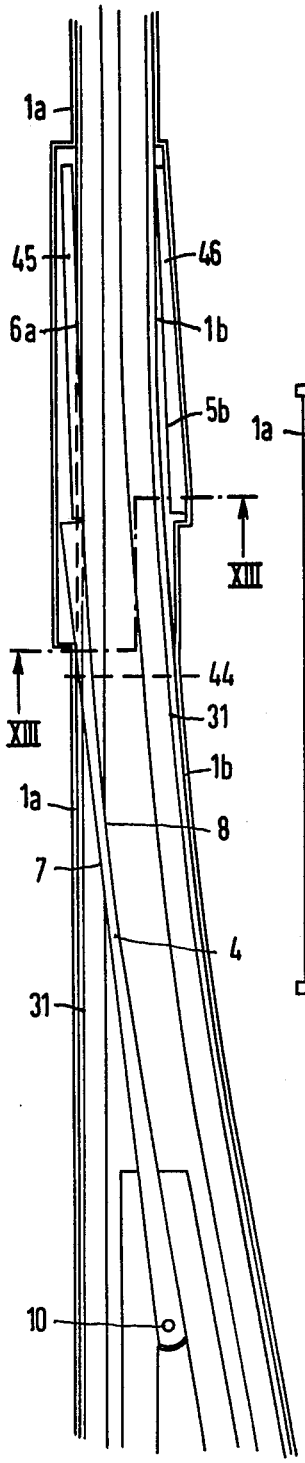
FIG. 12 illustrates a fifth embodiment of a switch in a top view.
Figure 13:
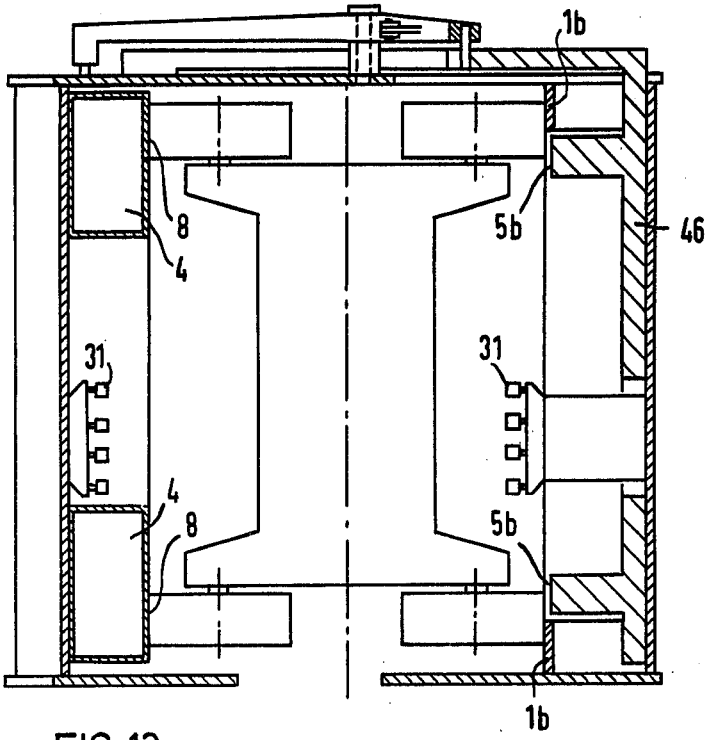
FIG. 13 is a cross section of FIG. 12.
Figure 14:
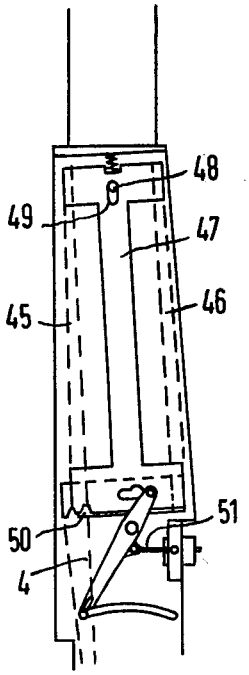
FIG. 14 is a top view onto the drive of the switch shown in FIG. 12.

In order to achieve this, in a switch according to FIGS. 12 to 14, in which a central switch point 4 forked at the end and two further switch points 45 and 46 are provided, the guide, rollers 26 are arranged so that they extend over the recess in the fixed guide surfaces 1*a* and 1*b* and cooperate only over about one-half of their width on the one side with the fixed guide surfaces 1*b* and 1*a*, respectively, and on the other side over one-half of their width with a guide surface 6*a* and 5*b*, respectively, of the additional switch points 45 and 46 (FIG.

12). Thereby, the central switch point 4 and the track support 1 in the switch can be kept very narrow.

The further switch points 45 and 46 are connected rigidly to a frame 47, as shown in FIG. 14. They can be swung about a vertical axis 48 by the frame 47. At the start of the swing motion, the frame can execute a longitudinal motion via the elongated hole 49. In the respective end position of the further switch points 45 and 46, the frame 47 is retained by dogs 50 so that the position of the frame is positively fixed and operational roller forces need not be held by the latching devices of the drive of the test rods. A conventional switch setting drive with a driving rod 51 and two test rods, not shown, of which one is connected to the movable central switch point 4 and the other to the frame 47.

When traveling into the branch, the vehicle is guided, in the region of the further switch points 45 and 46, on the left side by one-half of the guide surface 6*a* of the further switch point 45 and on the right side by one-half of the fixed guide surface 1*b* (FIGS. 12, 13).

What is claimed is:

1. In a switch for the carriage of a two track suspension railroad, in which two running surfaces for support wheels and, approximately perpendicularly thereto, parallel guide surfaces for lateral guide rollers are provided and in which, at the fork point of the inner guide surfaces, a central switch point pivoted about a vertical axis with guide surfaces on both long sides is linked onto the guide surfaces, the improvement comprising, the central switch point being made of one piece and two additional switch points in the region of its free end forming parallel guide surfaces, said additional switch points arranged in recesses of fixed guide surfaces and supported to be swung between the fixed guide surfaces and the central switch point, said guide rollers arranged in such a manner that they extend over the recess in the fixed guide surfaces and only one-half of their width cooperates with the fixed guide surfaces on the one side, and on the other side with one of the additional switch points.

2. The improvement according to claim 1, wherein said additional switch points are made flexible about vertical axes at the switch root, and the free ends of said switch points are coupled to follow the free end of the central switch point.

3. The improvement according to claim 1 and further including means supporting said central switch point for elastic displacement at its support point transversely to the travel axis.

4. In a switch for the carriage of a two track suspension railroad, in which two running surfaces for support wheels and approximately perpendicular thereto, parallel guide surfaces for lateral guide rollers are provided and in which, at the fork point of the inner guide surfaces, a central switch point pivoted about a vertical axis with guide surfaces on both long sides is linked onto the guide surfaces the improvement comprising:

(a) recesses in the fixed guide surfaces, (b) the central switch point being made of one piece and supported so that its free end can be swung into said recesses; and (c) the guide rollers arranged so that they extend over the recesses in the fixed guide surfaces and cooperate with the end region of the central switch point only over about one-half of their width.

* * * * *